US007803223B2

(12) United States Patent
Branagan

(10) Patent No.: US 7,803,223 B2
(45) Date of Patent: Sep. 28, 2010

(54) FORMATION OF METALLIC THERMAL BARRIER ALLOYS

(75) Inventor: Daniel James Branagan, Idaho Falls, ID (US)

(73) Assignee: The NanoSteel Company, Providence, RI (US)

( * ) Notice: Subject to any disclaimer, the term of this patent is extended or adjusted under 35 U.S.C. 154(b) by 530 days.

(21) Appl. No.: 11/324,576

(22) Filed: Jan. 3, 2006

(65) Prior Publication Data

US 2006/0110278 A1 May 25, 2006

Related U.S. Application Data

(63) Continuation of application No. 10/776,473, filed on Feb. 11, 2004, now abandoned.

(60) Provisional application No. 60/446,610, filed on Feb. 11, 2003.

(51) Int. Cl.

| | |
|---|---|
| ***B05D 1/08*** | (2006.01) |
| ***B05D 1/10*** | (2006.01) |
| ***C09D 1/00*** | (2006.01) |
| *B22F 1/00* | (2006.01) |

(52) U.S. Cl. ..... 106/286.3; 427/456; 427/427; 75/252; 428/457

(58) Field of Classification Search ..... 75/252; 106/286.3; 427/427, 456; 428/457
See application file for complete search history.

(56) References Cited

U.S. PATENT DOCUMENTS

| | | | | |
|---|---|---|---|---|
| 3,986,867 | A | 10/1976 | Masumoto et al. | 148/403 |
| 4,067,732 | A | 1/1978 | Ray | 148/403 |
| 4,290,808 | A | 9/1981 | Ray | 148/403 |
| 4,381,943 | A | 5/1983 | Dickson et al. | 75/356 |
| 4,473,401 | A | 9/1984 | Masumoto et al. | |
| 4,515,870 | A | 5/1985 | Bose et al. | 148/403 |
| 4,523,621 | A | 6/1985 | Ray | 164/46 |
| 4,822,415 | A | 4/1989 | Dorfman | |
| 4,923,533 | A * | 5/1990 | Shigeta et al. | 148/304 |
| 4,964,909 | A * | 10/1990 | Engstrom et al. | 75/246 |
| 4,965,139 | A * | 10/1990 | Kabacoff et al. | 428/682 |
| 5,643,531 | A | 7/1997 | Kim et al. | |
| 6,187,115 | B1 * | 2/2001 | Kretschmer et al. | 148/427 |
| 6,258,185 | B1 * | 7/2001 | Branagan et al. | 148/525 |
| 6,270,591 | B2 * | 8/2001 | Chiriac et al. | 148/300 |

FOREIGN PATENT DOCUMENTS

| | | |
|---|---|---|
| JP | 58213857 | 12/1983 |
| JP | 62130261 | 6/1987 |
| JP | 07278756 | 10/1995 |
| SU | 1615222 | 12/1990 |

OTHER PUBLICATIONS

European Supplemental Partial Search Report dated Feb. 26, 2008 issued in European Patent Application No. 04710240.5-2122 (5 pages).
European Office Action dated Jan. 23, 2009 issued in related European Patent Application No. 04710240.5.
European Office Action dated Apr. 22, 2010 issued in related European Patent Application No. 04710240.5-2122.
Japanese Office Action dated Mar. 3, 2010 issued in related Japanese Patent Application No. 2006-503500.

* cited by examiner

*Primary Examiner*—Roy King
*Assistant Examiner*—Ngoclan T Mai
(74) *Attorney, Agent, or Firm*—Grossman, Tucker, Perreault & Pfleger, PLLC

(57) ABSTRACT

Metal alloys having low electrical and thermal conductivity including relatively large fractions of P-Group element additions. The P-Group elements may be selected from the group including phosphorous, carbon, boron, and silicon. The resultant alloys do not exhibit significantly increased brittleness, and are applied as a coating that provides a metallic thermal barrier coating.

8 Claims, No Drawings

FORMATION OF METALLIC THERMAL BARRIER ALLOYS

CROSS REFERENCE TO RELATED APPLICATIONS

This application is a continuation of U.S. patent application Ser. No. 10/776,473 filed on Feb. 11, 2004, now abandoned which claims priority to U.S. Provisional Application No. 60/446,610 filed Feb. 11, 2003.

FIELD OF THE INVENTION

This invention is directed at metallic alloys, and more particularly at unique metallic alloys having low electrical and thermal conductivity. In coating form, when applied, such alloys present the ability to provide thermal barrier characteristics to a selected substrate.

BACKGROUND OF THE INVENTION

Metals and metallic alloys have metallic bonds consisting of metal ion cores surrounded by a sea of electrons. These free electrons which arise from an unfilled outer energy band allow the metal to have high electrical and thermal conductivity which makes this class of materials conductors. Due to the nature of the metallic bonds, metals and metallic alloys may exhibit a characteristic range of properties such as electrical and thermal conductivity. Typical metallic materials may exhibit values of electrical resistivity that generally fall in a range of between about 1.5 to 145 $10^{-8}$ Ωm, with iron having an electrical resistivity of about 8.6 $10^{-8}$ Ωm. Typical values of thermal conductivity for metallic materials may be in a range of between about 0.2 to 4.3 watts/cm ° C., with iron exhibiting a thermal conductivity of about 0.8 watts/cm ° C.

By contrast, ceramics are a class of materials which typically contain positive ions and negative ions resulting from electron transfer from a cation atom to an anion atom. All of the electron density in ceramics is strongly bonded resulting in a filled outer energy band. Ceramic alloys, due to the nature of their ionic bonding, will exhibit a different characteristic range of properties such as electrical and thermal conductivity. Because of the lack of free electrons, ceramics generally have poor electrical and thermal conductivity and are considered insulators. Thus, ceramics may be suitable for use in applications such as thermal barrier coatings while metals are not.

Designing a metal alloy to exhibit ceramic like electrical and thermal conductivities is unique. The only area where this has been utilized in material science is in the design of soft magnetic materials for transformer core applications. In such applications, extra silicon is added to iron in order to specifically reduce the electrical conductivity to minimize eddy current losses. However, iron-silicon alloys utilized for transformer cores typically contain a maximum of 2.5 at % (atomic percent) silicon because any additional silicon embrittles the alloy. Additionally, attempts to reduce electrical conductivity of iron transformer cores have not addressed reduced thermal conductivity.

SUMMARY OF THE INVENTION

A metal alloy comprising an alloy metal and greater than about 4 atomic % of at least one P-group alloying element. In method form, a method of reducing the thermal and/or electrical conductivity of a metal alloy composition comprising supplying a base metal with a free electron density, supplying a P-group alloying element and combining said P-group alloying element with said base metal and decreasing the free electron density of the base metal.

DESCRIPTION OF THE PREFERRED EMBODIMENT OF THE INVENTION

A metallic alloy is provided which exhibits relatively low thermal conductivity and a low electrical conductivity. The alloy may include primary alloying metals, such as iron, nickel, cobalt, aluminum, copper, zinc, titanium, zirconium, niobium, molybdenum, tantalum, vanadium, hafnium, tungsten, manganese, and combinations thereof, and increased fractions of P-Group elemental additions in the alloy composition. P-group elements are the non-metal and semi-metal constituents of groups IIIA, IVA, VA, VIA, and VIIA found in the periodic table, including but not limited to phosphorous, carbon, boron, silicon, sulfur, and nitrogen. The metallic alloy exhibiting relatively low thermal conductivity and electrical conductivity may be provided as a coating suitable for thermal and/or electrical barrier applications on a variety of substrates.

Consistent with the present invention, metallic alloys are provided that exhibit relatively low thermal and electrical conductivity. The alloys according to the present invention may include relatively high fractions of P-group elemental alloying additions in admixture with a metal. The added P-group elements may include, but are not limited to, carbon, nitrogen, phosphorus, silicon, sulfur and boron. The P-group elements may be alloyed with the metal according to such methods as by the addition of the P-group elements to the metal in a melt state.

Preferably, an alloy according to the present invention may include P-group alloying constituents. Such constituents are preferably present at a level of at least 4 at % (atomic percent) of the alloy. Desirably, the alloy consistent with the present invention may include more than one alloying component selected from P-group elements, such that the collective content of all of the P-group elements is between about 4 at % to 50 at %.

Consistent with the present invention, the alloy may include relatively large fractions of silicon in the alloy composition. For example, an iron/silicon coating alloy can be prepared according to the present invention which coating may be applied, e.g., to any given substrate. For example, it has been found that 5.0 atomic % of silicon, and greater, may be incorporated into the alloy without any measurable loss of toughness when employed in a coating application.

As alluded to above, consistent with the present invention, the metal alloy may be applied as a coating using a thermal spray process. The resulting coating maybe employed to provide a thermal and/or electrical barrier coating. The coating provides thermal and/or electrical barrier properties exhibited similar to a ceramic material, however without the associated brittleness of conventional ceramic coatings.

In addition to the use as a coating, the alloy of the present invention may also be processed by any know means to process a liquid melt including conventional casting (permanent mold, die, injection, sand, continuous casting, etc.) or higher cooling rate, i.e. rapid solidification, processes including melt spinning, atomization (centrifugal, gas, water, explosive), or splat quenching. One especially preferred method is to utilize atomization to produce powder in the target size range for various thermal spray coating application devices.

While not limiting the invention to any particular theory, it is believed at the time of filing that by alloying metals with P-group elements, including but not limited to carbon, nitrogen, phosphorus, and silicon, covalent bonds may be formed between the electrons in the P-group alloying element and the free electrons in the base metal, which base metal, as noted, may include iron. The interaction of the free electrons in the base metal in covalent bonds with the P-group alloying elements apparently act to reduce the free electron density of the base metal, and the outer electron energy band of the base metal is progressively filled. Accordingly, by adding significant quantities of P-group elements, the free electron density of the base metal can be continually reduced and the outer electron energy band can be progressively filled. Because the relatively high thermal conductively and electrical conductivity arise from the free electrons in the unfilled outer energy bands of the metal, as the free electron density is reduced, so are the electrical conductivity and the thermal conductivity. Therefore, the present invention provides a metal alloy that behaves similar to a ceramic with respect to electrical and thermal conductivity.

Experimental Observations

An exemplary alloy consistent with the present invention was prepared containing a combination of several alloying elements present at a total level of 25.0 atomic % P-group alloying elements in combination with, e.g. iron. The experimental alloy was produced by combining multiple P group elements according to the following distribution: 16.0 atomic % boron, 4.0 atomic % carbon, and 5.0 atomic % silicon with 54.5 atomic % iron, 15.0 atomic % chromium, 2.0 atomic % manganese, 2.0 atomic % molybdenum, and 1.5 atomic % tungsten.

The experimental alloy was prepared by mixing the alloying elements at the disclosed ratios and then melting the alloying ingredients using radio frequency induction in a ceramic crucible. The alloy was then processed into a powder form by first aspirating molten alloy to initiate flow, and then supplying high pressure argon gas to the melt stream in a close coupled gas atomization nozzle. The powder which was produced exhibited a Gaussian size distribution with a mean particle size of 30 microns. The atomized powder was further air classified to yield preferred powder sized either in the range of 10-45 microns or 22-53 microns. These preferred size feed stock powders were then sprayed onto selected metal substrates using high velocity oxy-fuel thermal spray systems to provide a coating on the selected substrates.

Reduced thermal behavior was observed for the exemplary alloy in a variety of experiments. Specifically, a small 5 gram ingot of the exemplary alloy was arc-melted on a water cooled copper hearth. It was observed that the alloy ingots took longer time for cooling back to room temperature, relative to other alloys which did not contain the P-group composition noted herein. More specifically, the increased time for cooling was on the order of about 20 times longer.

Additionally, while conventional metals and alloys that have been heated to high temperatures cool below their red hot radiance level in a few seconds, it was observed that when the exemplary alloy herein was heated to a temperature above the red hot radiance level of the alloy, the red hot radiance persisted for several minutes after removal of the heat source.

Similarly, conventional metals and metallic alloys typically cool rapidly from a melt state on a conventional water cooled copper arc-melter, and can be safely handled in a matter of a few minutes. The experimental alloy prepared as described above required in excess of 30 minutes to cool from a melt state down to a safe handling temperature after being melted on a water cooled copper hearth arc-melter.

Finally, when thermally sprayed the experimental alloy powder does not transfer heat sufficiently using conventional operating parameters due to its relatively low conductivity and inability to absorb heat. When using high velocity oxy-fuel thermal spray system, conventional alloys can be sprayed with equivalence ratios (kerosene fuel/oxygen fuel flow rate) equal to 0.8. Because of the low thermal conductivity of the modified experimental alloys, much higher equivalence ratios, in the range of 0.9-1.2, are necessary in order to provide sufficient heating of the powder. Additionally, when deposited via the LENS (Laser Engineered Net Shape) process, in which a high powered laser is used to melt metal powder supplied to the focus of the laser by a deposition head, the very thin deposit (225 μm thick weld) took excessive time before another layer can be deposited since it glows red hot for an extended time.

In the broad context of the present invention alloy compositions of the following are to be noted, with the numbers reflecting atomic %: SHS717 Powder, with an alloy composition of Fe (52.3), Cr (19.0), Mo (2.5), W (1.7), B (16.0), C (4.0), Si (2.5) and Mn (2.0); SHS717 wire, with an alloy composition of Fe (55.9), Cr (22.0), Mo (0.6), W (0.4), B (15.6), C (3.5), Si (1.2) and Mn (0.9).

The thermal conductivity data for the SHS717 coatings was measured by a Laser Flash method and the results are given in Table 1. Note that the wire-arc conductivity is generally lower than the HVOF due to the higher porosity in the wire-arc coating. Note that the conductivity of the coatings is lower than that of titanium which is the lowest thermal conductivity metal and at room temperature are even lower than alumina ceramic (see Table 2).

TABLE 1

Thermal Conductivity Data for SHS717 Coatings

| Coating Type | Temperature (° C.) | Conductivity (W/m-K) |
|---|---|---|
| HVOF | 25 | 5.07 |
| HVOF | 200 | 6.93 |
| HVOF | 400 | 10.0 |
| HVOF | 600 | 14.2 |
| Wire-Arc | 25 | 4.14 |
| Wire-Arc | 200 | 4.78 |
| Wire-Arc | 400 | 5.48 |
| Wire-Arc | 600 | 6.94 |

TABLE 2

Comparative Thermal Conductivity Data

| Alloy | 25° C. (298 K) W/m-K | 400° C. (673 K) W/m-K | 600° C. (873 K) W/m-K |
|---|---|---|---|
| Al | 239 | 227.5 | 213.5 |
| Au | 311 | 270.5 | 258* |
| Cu | 383 | 367* | 352* |
| Fe | 79.1 | 49.11 | 39.8 |
| Ni | 74.9 | 63.0 | 72* |
| Ti | 22.0* | 14.0 | 13.3 |
| .31 wt % Carbon Steel | 69.5* | 26.5 | 20.0 |
| .65 wt % Carbon Steel | 64.7* | 23.8 | 18.7 |
| .88 wt % Carbon Steel | 59.0* | 22.6 | 18.5 |
| British Steel #7 | 49.6* | 38.1 | 29.9 |
| White Cast Iron | 12.8* | 21.8 | 19.8 |
| Grey Cast Iron | 29.5* | 34.1 | 23.8 |
| 717HV | 5.07 | 10.00 | 14.20 |
| 717WA | 4.14 | 5.48 | 6.94 |
| 302 Stainless Steel | 12.3 | 18.6 | 22.1 |
| 303 Stainless Steel | 14.4* | 19.7 | 23.0 |

TABLE 2-continued

| Comparative Thermal Conductivity Data | | | |
|---|---|---|---|
| Alloy | 25° C. (298 K) W/m-K | 400° C. (673 K) W/m-K | 600° C. (873 K) W/m-K |
| 310 Stainless Steel | 13.3* | 20.1 | 25.1 |
| 430 Stainless Steel | 22.0* | 23.3 | 24.0 |
| 446 Stainless Steel | 17.6* | 19.8 | 21.0 |
| Alumina Ceramic | 24.5* | 8.2 | 6.69 |

*Approximated Value

What is claimed is:

1. A metallic thermal barrier coating comprising an iron base alloy metal wherein iron is present at 52.3-55.9 atomic %, chromium at 19.0-22.0 atomic %, molybdenum at 0.6-2.5 atomic %, tungsten at 0.4-1.7 atomic %, manganese at 0.9-2.0 atomic %, carbon at 3.5-4.0 atomic %, boron at 15.6-16.0 atomic %, and at least 1.2 atomic % silicon, wherein said metallic thermal barrier coating has a thermal conductivity equal to or less than about 10 W/m-K at 400 degrees Celsius.

2. The metallic thermal barrier coating of claim 1 wherein iron is present at 52.3 atomic %, chromium at 19.0 atomic %, molybdenum at 2.5 atomic %, tungsten at 1.7 atomic %, boron at 16.0 atomic %, carbon at 4.0 atomic %, silicon at 2.5 atomic % and manganese at 2.0 atomic %.

3. The metallic thermal barrier coating according to claim 1, wherein boron is present at 16.0 atomic % and carbon is present at 4.0 atomic %.

4. The metallic thermal barrier coating according to claim 1 wherein iron is present at 55.9 atomic %, chromium at 22.0 atomic %, molybdenum at 0.6 atomic %, tungsten at 0.4 atomic %, boron at 15.6 atomic %, carbon at 3.5 atomic %, silicon at 1.2 atomic %, and manganese at 0.9 atomic %.

5. A method for producing a metallic thermal barrier coating composition comprising: (a) supplying an iron base metal alloy composition wherein iron is present at 52.3-55.9 atomic %, chromium at 19.0-22.0 atomic %, molybdenum at 0.6-2.5 atomic %, tungsten at 0.4-1.7 atomic %, manganese at 0.9-2.0 atomic %, carbon at 3.5-4.0 atomic %, boron at 15.6-16.0 atomic %, and at least 1.2 atomic % silicon; (b) mixing said metal alloy composition and; (c) forming a metallic barrier thermal coating using a thermal spray process, wherein said metallic thermal barrier coating composition has a thermal conductivity equal to or less than about 10 W/m-K at 400 degrees Celsius.

6. The method of claim 5, wherein iron is present at 52.3 atomic %, chromium at 19.0 atomic %, molybdenum at 2.5 atomic %, tungsten at 1.7 atomic %, boron at 16.0 atomic %, carbon at 4.0 atomic %, silicon at 2.5 atomic % and manganese at 2.0 atomic %.

7. The method of claim 5, wherein iron is present at 55.9 atomic %, chromium at 22.0 atomic %, molybdenum at 0.6 atomic %, tungsten at 0.4 atomic %, boron at 15.6 atomic %, carbon at 3.5 atomic %, silicon at 1.2 atomic %, and manganese at 0.9 atomic %.

8. The metallic thermal barrier coating of claim 1, wherein metallic thermal barrier coating composition is sourced from a powder having a particle size in the range of 10 to 45 microns or 22 to 53 microns.

* * * * *